US012024833B2

(12) United States Patent
Murray et al.

(10) Patent No.: US 12,024,833 B2
(45) Date of Patent: Jul. 2, 2024

(54) PORTABLE ROAD SEGMENT WEDGE AND PIN CONNECTION AND METHOD

(71) Applicant: United States of America as Represented by The Secretary of The Army, Alexandria, VA (US)

(72) Inventors: Matthew P Murray, Vicksburg, MS (US); Gary E Johnston, Vicksburg, MS (US); David A Nguyen, Vicksburg, MS (US); Christopher M Ables, Vicksburg, MS (US); Thad C Pratt, Vicksburg, MS (US)

(73) Assignee: UNITED STATES OF AMERICA AS REPRESENTED BY THE SECRETARY OF THE ARMY, Alexandria, VA (US)

( * ) Notice: Subject to any disclaimer, the term of this patent is extended or adjusted under 35 U.S.C. 154(b) by 0 days.

(21) Appl. No.: 17/486,934

(22) Filed: Sep. 28, 2021

(65) Prior Publication Data

US 2023/0102143 A1 Mar. 30, 2023

(51) Int. Cl.
*E01D 15/133* (2006.01)
*E01C 5/00* (2006.01)
*E01D 15/14* (2006.01)

(52) U.S. Cl.
CPC ..... *E01D 15/133* (2013.01); *E01C 5/005* (2013.01); *E01D 15/14* (2013.01)

(58) Field of Classification Search
CPC ..... E01C 5/005; E01D 15/12; E01D 15/133; E01D 15/14; E01D 15/20; E01D 15/22
USPC ..... 14/2.4, 2.6
See application file for complete search history.

(56) References Cited

U.S. PATENT DOCUMENTS 3,818,854 A * 6/1974 Marriner ..... B63B 35/70 114/249
4,695,184 A * 9/1987 Robishaw ..... B60P 7/13 403/321
5,606,929 A * 3/1997 Huang ..... B63B 35/38 114/77 R (Continued)

FOREIGN PATENT DOCUMENTS

CN 207687205 U * 8/2018
WO WO-2021054836 A1 * 3/2021 ..... B63B 35/38

*Primary Examiner* — Gary S Hartmann
(74) *Attorney, Agent, or Firm* — Brian C. Jones

(57) ABSTRACT

Portable road segments, herein referred to as surface vehicles, include first and second surface vehicles. A female wedge mount is attached to the first surface vehicle. The female wedge mount has a concave contact surface including three or more female contact surface segments an at least two female wedge slots. A male wedge mount is attached to the second surface vehicle. The male wedge mount has a convex contact surface including three or more male contact surface segments and at least two male wedge slots that are aligned with the at least two female wedge slots, respectively, when the convex contact surface of the male wedge mount and the concave contact surface of the female wedge mount are in aligned contact with one another to form an adjacent connection between the first and second surface vehicles. A mechanism includes at least two pins that are movable along the at least two male and female wedge slots, respectively, between unlocked and locked positions.

20 Claims, 11 Drawing Sheets

(56) References Cited

U.S. PATENT DOCUMENTS

| | | | | |
|---|---|---|---|---|
| 7,063,036 | B2 * | 6/2006 | Han | B63B 3/08 114/352 |
| 2021/0131041 | A1 * | 5/2021 | Penland, Jr. | E01C 13/045 |
| 2023/0158773 | A1 * | 5/2023 | Forbes | B32B 7/08 404/35 |

* cited by examiner

PORTABLE ROAD SEGMENT WEDGE AND PIN CONNECTION AND METHOD

STATEMENT OF GOVERNMENT INTEREST

Under paragraph 1(a) of Executive Order 10096, the conditions under which this invention was made entitle the Government of the United States, as represented by the Secretary of the Army, to an undivided interest therein on any patent granted thereon by the United States. This and related patents are available for licensing to qualified licensees.

BACKGROUND

Field of the Invention

The present invention relates to apparatuses and methods of connecting, portable road segments, herein referred to as surface vehicles and, more specifically, surface vehicles for supporting payloads.

Description of the Related Art

This section introduces aspects that may help facilitate a better understanding of the invention. Accordingly, the statements of this section are to be read in this light and are not to be understood as admissions about what is prior art or what is not prior art.

Providing adjacent connections between surface vehicles may achieve different functions and serve a variety of purposes. For example, two or more surface vehicles can be connected together to provide a platform of sufficient size and/or strength to support a payload to be moved across a body of water. A plurality of surface vehicles may be connected together to form a bridge across a body of water.

SUMMARY

The present invention was developed to address the desire for a robust and reliable way to connect surface vehicles that requires little to no human intervention or input. Research and development have led to a novel connecting apparatus having a wedge configuration that enables a female wedge mount and a male wedge mount to self-align by sliding contact from a separated state to an aligned contact state, without the need for human intervention or input.

Embodiments of the present invention provide at least one connecting apparatus each including a female wedge mount and a male wedge mount for making aligned wedge contact between two adjacent surface vehicles. Examples of surface vehicles include unmanned surface vehicles or vessels (USVs) or autonomous surface vehicles (ASVs). The female wedge mount has a concave contact surface. The male wedge mount has a convex contact surface. A locking mechanism is configured to engage the female wedge mount and the male wedge mount to be movable between an unlocked state and a locked state, when the convex contact surface of the male wedge mount and the concave contact surface of the female wedge mount are in aligned contact or aligned wedge contact with one another.

The present invention advances the technology of connecting and disconnecting surface vehicles. Key to the success of this apparatus is, among others, the ability to provide alignment correction so as to align the surface vehicles automatically during connection of the surface vehicles within dynamic riverine environments or other dynamic situations. The connecting apparatus is further designed with the structural capacity at the connections to support a heavy payload over multiple linked surface vehicle platforms of a plurality of surface vehicles connected using the connecting apparatuses and floating in buoyancy on a body of water. This is accomplished by the male and female wedge-shaped mounts in the connecting apparatus which are capable of correcting a large degree of misalignment between the surface vehicles to be connected. As described in more detail below, locking pins are engaged once the wedge mounts have "docked" in aligned contact connection or wedge contact connection to provide the structural capacity to support the payload.

An aspect of the present invention is directed to an apparatus for making an adjacent connection between a first surface vehicle and a second surface vehicle. A female wedge mount is configured to be attached to the first surface vehicle, the female wedge mount having a concave contact surface including three or more female contact surface segments, the female wedge mount having at least two female wedge slots. A male wedge mount is configured to be attached to the second surface vehicle, the male wedge mount having a convex contact surface including three or more male contact surface segments corresponding to and matching in shape with, respectively, the three or more female contact surface segments, the male wedge mount having at least two male wedge slots that are aligned with the at least two female wedge slots, respectively, when the convex contact surface of the male wedge mount and the concave contact surface of the female wedge mount are in aligned contact with one another to form the adjacent connection. A mechanism is configured to engage the female wedge mount and the male wedge mount and including at least two pins that are, when the convex contact surface of the male wedge mount and the concave contact surface of the female wedge mount are in aligned contact with one another, movable between a first position and a second position, the at least two pins in the first position extending through the at least two male wedge slots and the at least two female wedge slots, respectively, the at least two pins in the second position withdrawing from the at least two female wedge slots or the at least two male wedge slots, respectively.

Another aspect of the invention is directed to an apparatus for making an adjacent connection between a first surface vehicle and a second surface vehicle. A female wedge mount is configured to be attached to the first surface vehicle, the female wedge mount having three or more female contact surface segments, the female wedge mount having at least two female wedge slots. A male wedge mount is configured to be attached to the second surface vehicle, the male wedge mount having three or more male contact surface segments, the male wedge mount having at least two male wedge slots that are aligned with the at least two female wedge slots, respectively, when the three or more male contact surface segments of the male wedge mount and the three or more female contact surface segments of the female wedge mount are in aligned contact with one another, respectively, to form the adjacent connection. At least two of the three or more female contact surface segments correspond to and match in shape with, respectively, at least two of the three or more male contact surface segments and oriented to align the female wedge mount and the male wedge mount horizontally. At least two of the three or more female contact surface segments correspond to and match in shape with, respectively, at least two of the three or more male contact surface segments and oriented to align the female wedge mount and the male wedge mount vertically. A mechanism is configured to engage the female wedge mount and the male wedge mount and including at least two pins that are, when the three or more male contact surface segments of the male wedge mount and the three or more female contact surface segments of the female wedge mount are in aligned contact with one another, movable between a first position and a second position, the at least two pins in the first position extending through the at least two male wedge slots and the at least two female wedge slots, respectively, the at least two pins in the second position withdrawing from the at least two female wedge slots or the at least two male wedge slots, respectively.

In accordance with yet another aspect of this invention, a method for making an adjacent connection between a first surface vehicle and a second surface vehicle comprises: attaching a first female wedge mount to the first surface vehicle, the first female wedge mount having three or more first female contact surface segments, the first female wedge mount having at least two first female wedge slots; attaching a first male wedge mount to the second surface vehicle, the first male wedge mount having three or more first male contact surface segments, the first male wedge mount having at least two first male wedge slots; and bringing the three or more first male contact surface segments of the first male wedge mount and the three or more first female contact surface segments of the first female wedge mount in aligned contact with one another, respectively, to form the adjacent connection, in which the at least two first male wedge slots are aligned with the at least two first female wedge slots, respectively. At least two of the three or more first female contact surface segments correspond to and match in shape with, respectively, at least two of the three or more first male contact surface segments and oriented to align the first female wedge mount and the first male wedge mount horizontally. At least two of the three or more first female contact surface segments correspond to and match in shape with, respectively, at least two of the three or more first male contact surface segments and oriented to align the first female wedge mount and the first male wedge mount vertically. The method further comprises engaging the first female wedge mount and the first male wedge mount by moving at least two first pins to a first position extending through the at least two first male wedge slots and the at least two first female wedge slots, respectively.

Embodiments of the connecting apparatus can be used for making adjacent connections between surface vehicles to provide a platform of sufficient size and/or strength to support a payload to be moved across a body of water. The connecting apparatus may also be adapted to make adjacent connections between other types of vehicles to support payloads.

BRIEF DESCRIPTION OF THE DRAWINGS

Embodiments of the invention will become more fully apparent from the following detailed description, the appended claims, and the accompanying drawings in which like reference numerals identify similar or identical elements.

DETAILED DESCRIPTION

Detailed illustrative embodiments of the present invention are disclosed herein. However, specific structural and functional details disclosed herein are merely representative for purposes of describing example embodiments of the present invention. The present invention may be embodied in many alternate forms and should not be construed as limited to only the embodiments set forth herein. Further, the terminology used herein is for the purpose of describing particular embodiments only and is not intended to be limiting of example embodiments of the invention.

As used herein, the singular forms "a," "an," and "the," are intended to include the plural forms as well, unless the context clearly indicates otherwise. It further will be understood that the terms "comprises," "comprising," "includes," and/or "including," specify the presence of stated features, steps, or components, but do not preclude the presence or addition of one or more other features, steps, or components. It also should be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Embodiments of the present invention provide apparatuses and methods of connecting surface vehicles and, more specifically, surface vehicles for supporting payloads. A connecting apparatus includes a female wedge mount and a male wedge mount for making aligned wedge contact between two adjacent surface vehicles. The female wedge mount has a concave contact surface. The male wedge mount has a convex contact surface. A locking mechanism is configured to engage the female wedge mount and the male wedge mount to be movable between an unlocked state and a locked state, when the convex contact surface of the male wedge mount and the concave contact surface of the female wedge mount are in aligned contact or aligned wedge contact with one another. The connecting apparatus has the ability to provide alignment correction so as to align the surface vehicles automatically during connection of the surface vehicles within dynamic riverine environments or other dynamic situations. The connecting apparatus has the structural capacity to support a heavy payload over linked surface vehicle platforms of a plurality of surface vehicles connected and floating in buoyancy on a body of water.

Figure 1:
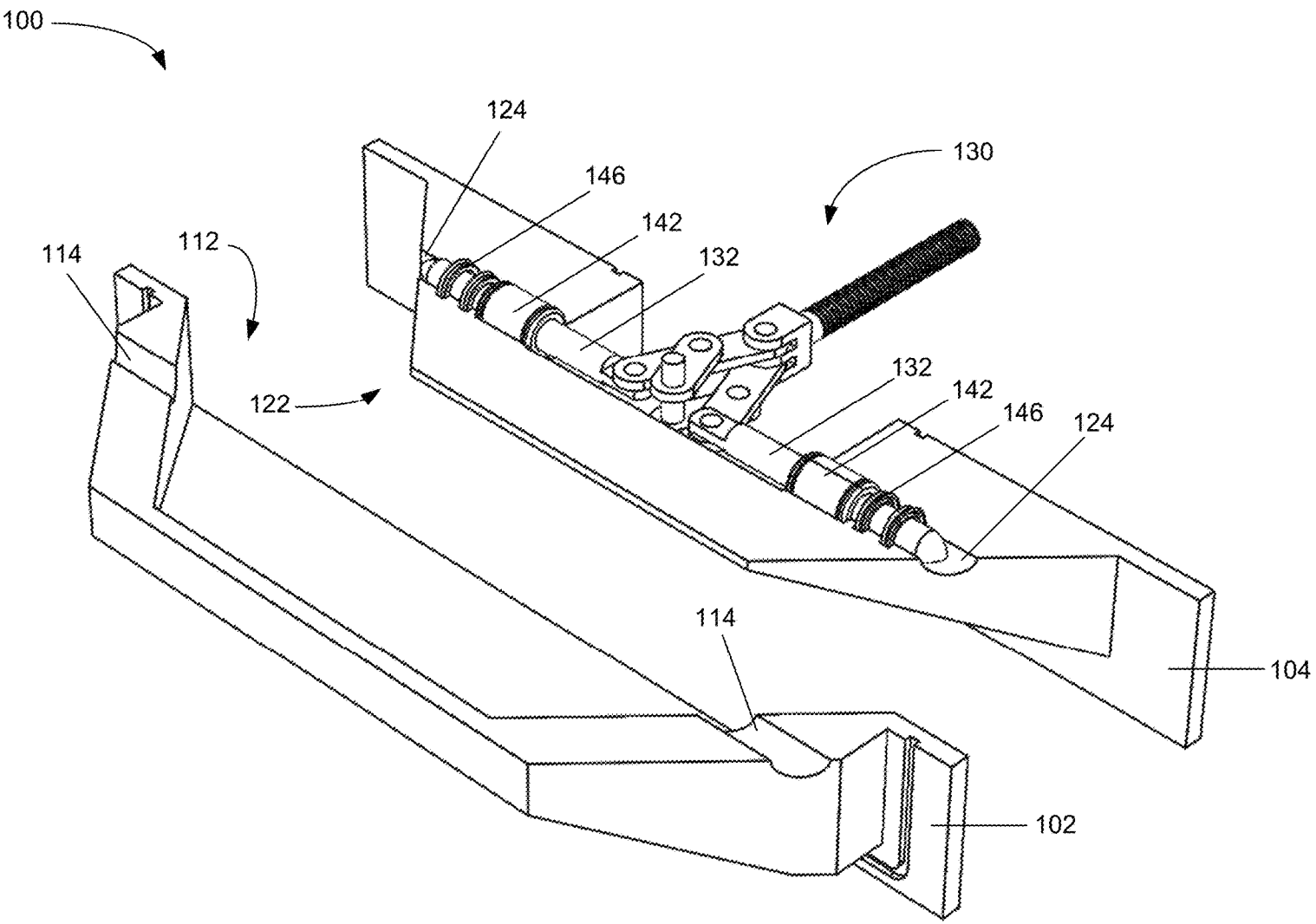
FIG. 1 is a perspective view of the lower half of surface vehicle connecting apparatus illustrating a female wedge mount and a male wedge mount separated from one another, according to an embodiment of the present invention.

FIG. 1 is a perspective view of the lower half of surface vehicle connecting apparatus 100 illustrating a female wedge mount 102 and a male wedge mount 104 separated from one another, according to an embodiment of the present invention. The top half of the female wedge mount 102 and the top half of the male wedge mount 104 are removed in this view to show the interior details. The apparatus 100 may be used for making an adjacent connection between a first surface vehicle and a second surface vehicle. Such an adjacent connection may be a front end (leading edge) to rear end (trailing edge) connection. A locking or engagement mechanism 130 is configured to engage the female wedge mount 102 and the male wedge mount 104. In the embodiment shown, the mechanism 130 includes at least two pins 132 which are locking pins that are movable between an unlocked state and a locked state.

The female wedge mount 102 may be configured to be attached to the first surface vehicle. The female wedge mount 102 has a concave contact surface 112 including three or more female contact surface segments. The female wedge mount 102 has at least two female wedge slots 114.

The male wedge mount 104 may be configured to be attached to the second surface vehicle. The male wedge mount 104 has a convex contact surface 122 including three or more male contact surface segments corresponding to and matching in shape with, respectively, the three or more female contact surface segments. The male wedge mount 104 has at least two male wedge slots 124 that are aligned with the at least two female wedge slots 114, respectively, when the convex contact surface 122 of the male wedge mount 104 and the concave contact surface 112 of the female wedge mount 102 are in aligned contact with one another to form the adjacent connection.

In the embodiment shown, the three or more female contact surface segments are each planar and the three or more male contact surface segments are each planar and match in shape with, respectively, the three or more planar female contact surface segments. In other embodiments, the contact surface segments may have curvatures, undulating portions, or the like. The planar contact surface segments are simple and ensure a stable aligned contact to form the adjacent wedge connection. Other surface shapes may be used as long as they provide a stable aligned contact. For example, a ball joint type connection may not produce a stable aligned contact due to the rotational freedom of movement.

At least two of the three or more female contact surface segments correspond to and match in shape with, respectively, at least two of the three or more male contact surface segments and are oriented to align the female wedge mount 102 and the male wedge mount 104 horizontally. At least two of the three or more female contact surface segments correspond to and match in shape with, respectively, at least two of the three or more male contact surface segments and are oriented to align the female wedge mount 102 and the male wedge mount 104 vertically. An example is shown in FIGS. 2A and 2B.

Figure 2A:
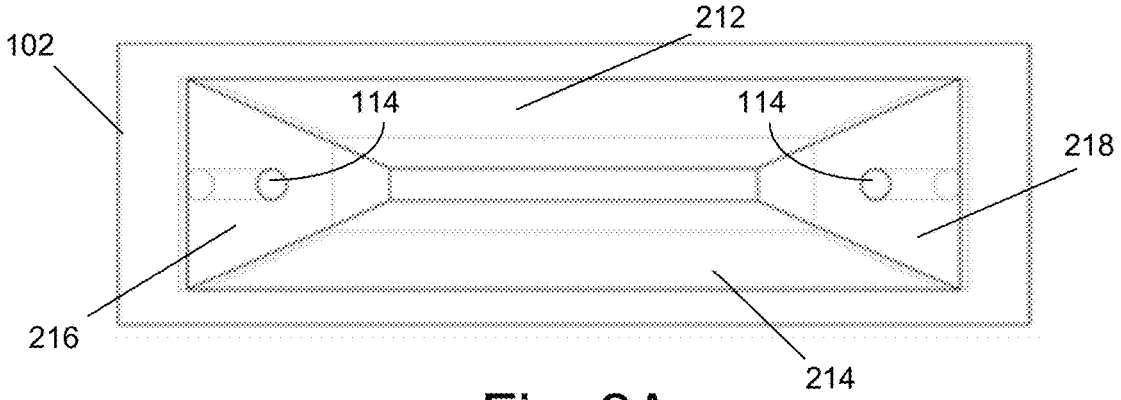
FIG. 2A is a front elevational view of the female wedge mount of the surface vehicle connecting apparatus of FIG. 1.
Figure 2B:
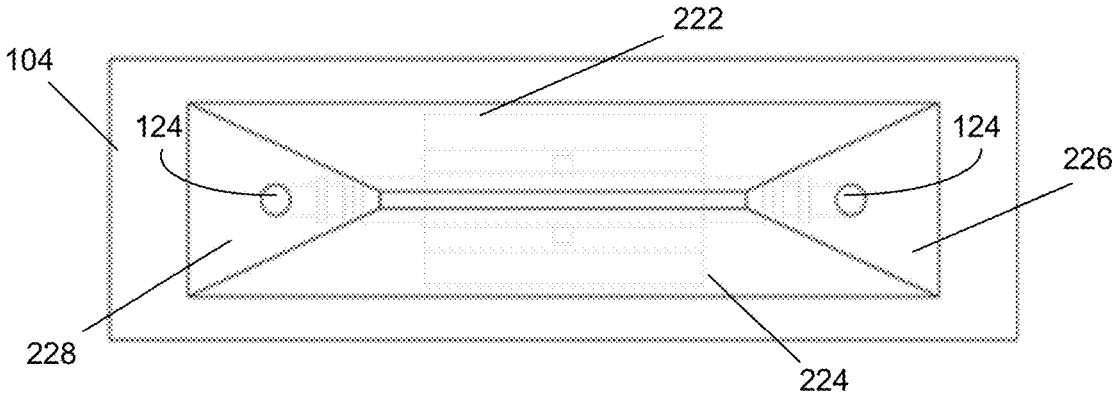
FIG. 2B is a front elevational view of the male wedge mount of the surface vehicle connecting apparatus of FIG. 1.

FIG. 2A is a front elevational view of the female wedge mount 102 of the surface vehicle connecting apparatus 100 of FIG. 1. FIG. 2B is a front elevational view of the male wedge mount 104 of the surface vehicle connecting apparatus 100 of FIG. 1.

The concave contact surface 112 of the female wedge mount 102 has four female contact surface segments and the convex contact surface of the male wedge mount 104 has four male contact surface segments corresponding to and matching in shape with, respectively, the four female contact surface segments.

In the embodiment shown, the four female contact surface segments of the concave contact surface 112 of the female wedge mount 102 include an upper female contact surface segment 212, a lower female contact surface segment 214, a left side female contact surface segment 216, and a right side female contact surface segment 218. The four male contact surface segments of the convex contact surface 122 of the male wedge mount 104 include an upper male contact surface segment 222, a lower male contact surface segment 224, a left side male contact surface segment 226, and a right side male contact surface segment 228.

The female wedge mount 102 has at least two horizontal female wedge slots 114 that extend through the left side female contact surface segment 216 and the right side female contact surface segment 218, respectively. The male wedge mount 104 has at least two horizontal male wedge slots 124 that extend through the left side male contact surface segment 226 and the right side male contact surface segment 228, respectively, and that are aligned with the at least two horizontal female wedge slots 114, respectively, when the convex contact surface 122 of the male wedge mount 104 and the concave contact surface 112 of the female wedge mount 102 are in aligned contact with one another to form the adjacent connection.

The left side and right side contact surface segments (216, 218, 226, 228) are oriented to align the female wedge mount 102 and the male wedge mount 104 horizontally. The upper and lower contact surface segments (212, 214, 222, 224) are oriented to align the female wedge mount 102 and the male wedge mount 104 vertically. The wedge configuration enables the female wedge mount 102 and the male wedge mount 104 to self-align.

Figure 2C:
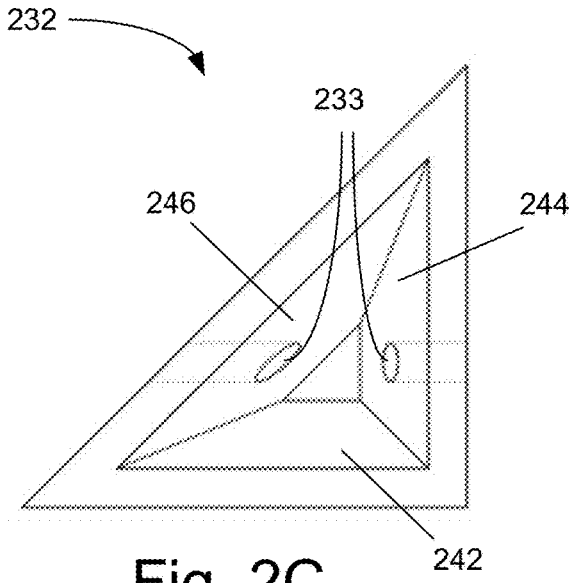
FIG. 2C is a front elevational view of a female wedge mount having three female contact surface segments according to another embodiment.
Figure 2D:
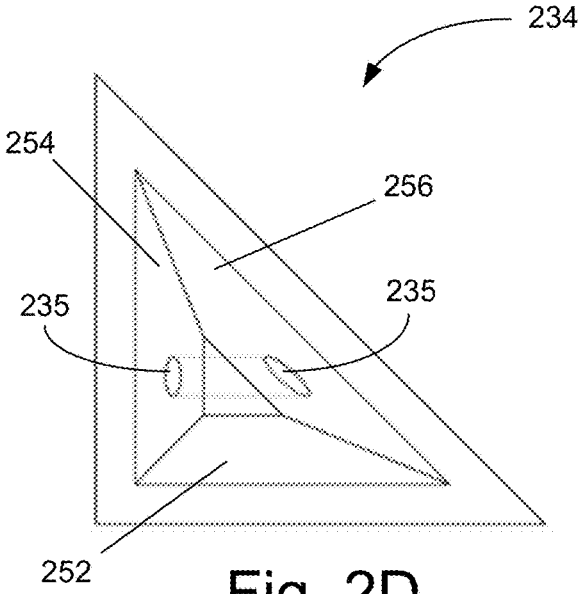
FIG. 2D is a front elevational view of a male wedge mount having three male contact surface segments according to another embodiment.

FIG. 2C is a front elevational view of a female wedge mount 232 according to another embodiment. FIG. 2D is a front elevational view of a male wedge mount 234 according to another embodiment. The female wedge mount 232 has a concave contact surface including three female contact surface segments 242, 244, 246. The male wedge mount 234 has a convex contact surface including three male contact surface segments 252, 254, 256.

The female wedge mount 232 has at least two horizontal female wedge slots 233 that extend through the right side female contact surface segment 244 and the oblique female contact surface segment 246, respectively. The male wedge mount 234 has at least two horizontal male wedge slots 235 that extend through the right side male contact surface segment 254 and the oblique male contact surface segment 256, respectively, and that are aligned with the at least two horizontal female wedge slots 233, respectively, when the convex contact surface of the male wedge mount 234 and the concave contact surface of the female wedge mount 232 are in aligned contact with one another to form the adjacent connection.

The right side female contact surface segment 244 and the oblique female contact surface segment 246 correspond to and match in shape with, respectively, the right side male contact surface segment 254 and the oblique male contact surface segment 256 and are oriented to align the female wedge mount 232 and the male wedge mount 234 horizontally. The lower female contact surface segment 242 and the oblique female contact surface segment 246 correspond to and match in shape with, respectively, the lower male contact surface segment 252 and the oblique male contact surface segment 256 and are oriented to align the female wedge mount 102 and the male wedge mount 104 vertically.

Figure 3A:
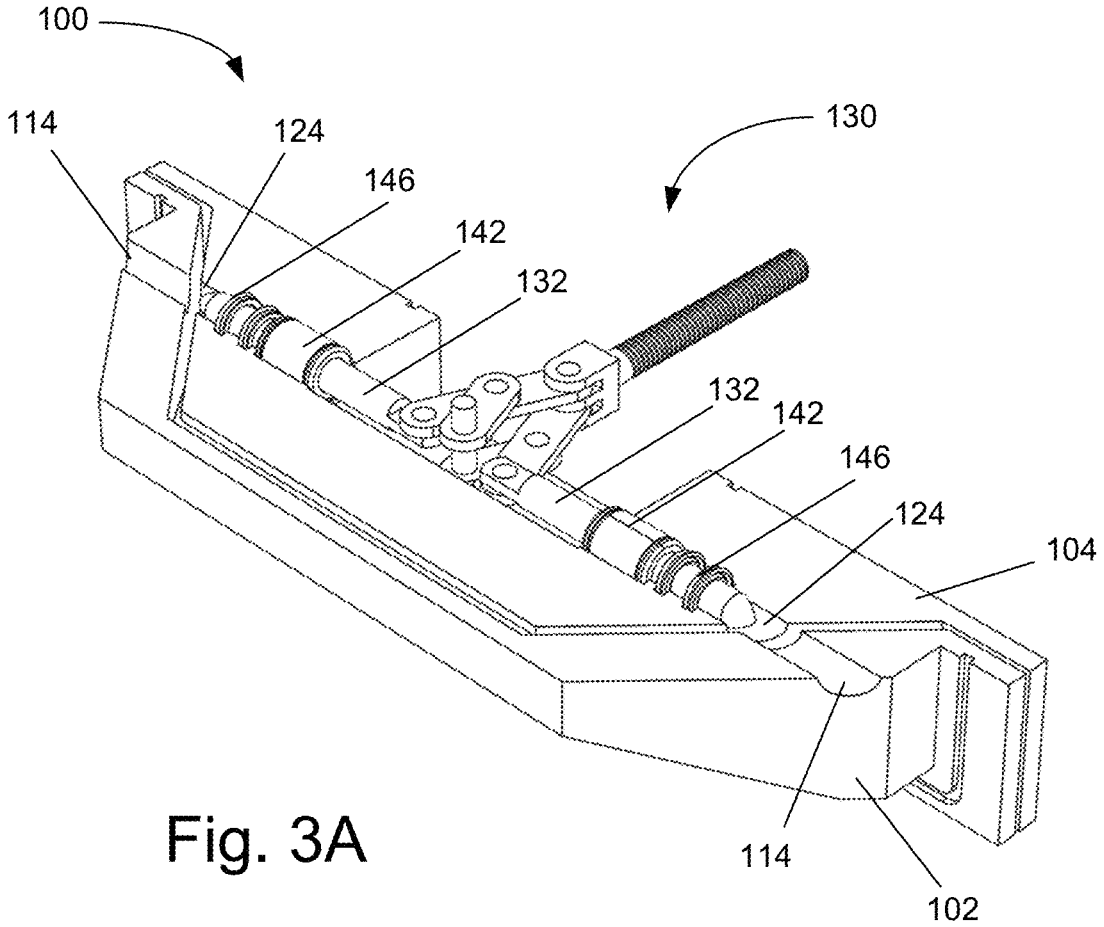
FIG. 3A is a perspective view of the lower half of the surface vehicle connecting apparatus of FIG. 1 illustrating the male wedge mount and the female wedge mount in aligned contact with one another.

FIG. 3A is a perspective view of the lower half of the surface vehicle connecting apparatus of FIG. 1 illustrating the male wedge mount 104 and the female wedge mount 102 in aligned contact or wedge contact or aligned wedge contact with one another. When the convex contact surface 122 of the male wedge mount 104 and the concave contact surface 112 of the female wedge mount 102 are in aligned contact with one another, the locking pins 132 are movable between a first position and a second position. For example, the locking pins 132 are in the second (unlocked) position in FIG. 3A and in the first (locked) position in FIG. 3B. To facilitate sliding motion of the locking pins 132 relative to the female wedge slots 114 and male wedge slots 124, linear bearings 142 may be provided in and attached to the female wedge slots 114. Rod seals or pin seals 146 may be provided in the female wedge slots 114 to keep water and other liquid from entering interior portions of the connecting apparatus 100 or the surface vehicles. The seals 146 may be rubber O-rings or the like.

Figure 3B:
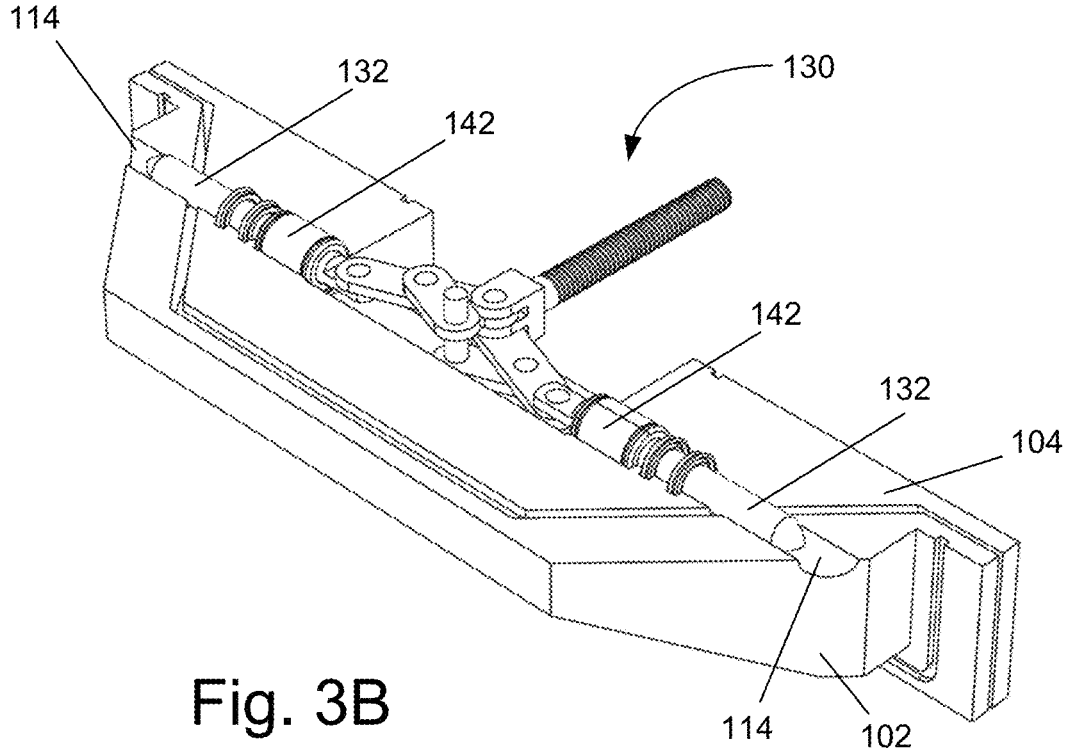
FIG. 3B is a perspective view of the lower half of the surface vehicle connecting apparatus of FIG. 1 illustrating the male wedge mount and the female wedge mount in aligned contact with one another with a locking mechanism in a locked state.

FIG. 3B is a perspective view of the lower half of the surface vehicle connecting apparatus of FIG. 1 illustrating the male wedge mount 104 and the female wedge mount 102 in aligned contact with one another in a locked state. The locking pins 132 in the first (locked) position extend through the at least two male wedge slots 124 and the at least two female wedge slots 114, respectively. The locking pins 132 in the second (unlocked) position withdraw from the at least two female wedge slots 114 or the at least two male wedge slots 124, respectively. In the example shown in FIG. 3A, the locking pins 132 withdraw from the female wedge slots 114.

Figure 4A:
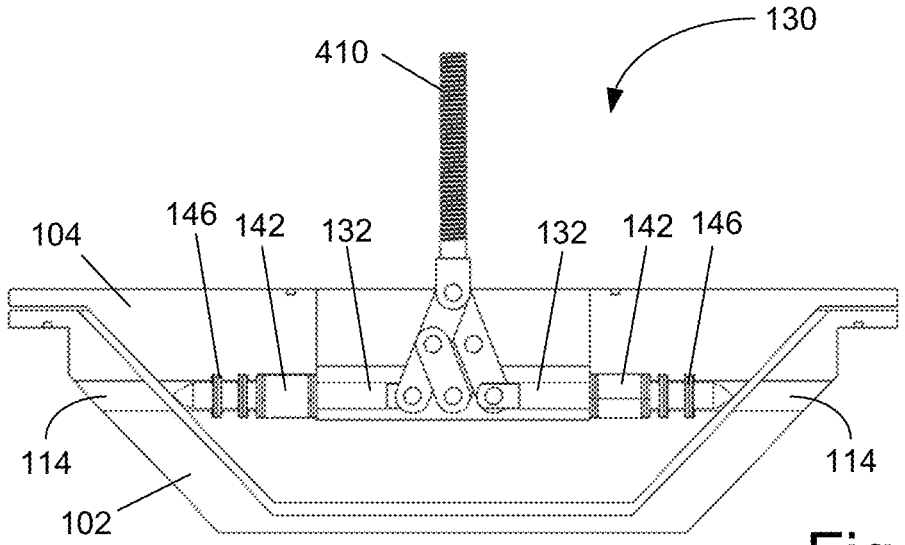
FIG. 4A is a top plan view of the lower half of the surface vehicle connecting apparatus of FIG. 3A illustrating the male wedge mount and the female wedge mount in aligned contact with one another with the locking mechanism in an unlocked state of FIG. 3A.
Figure 4B:
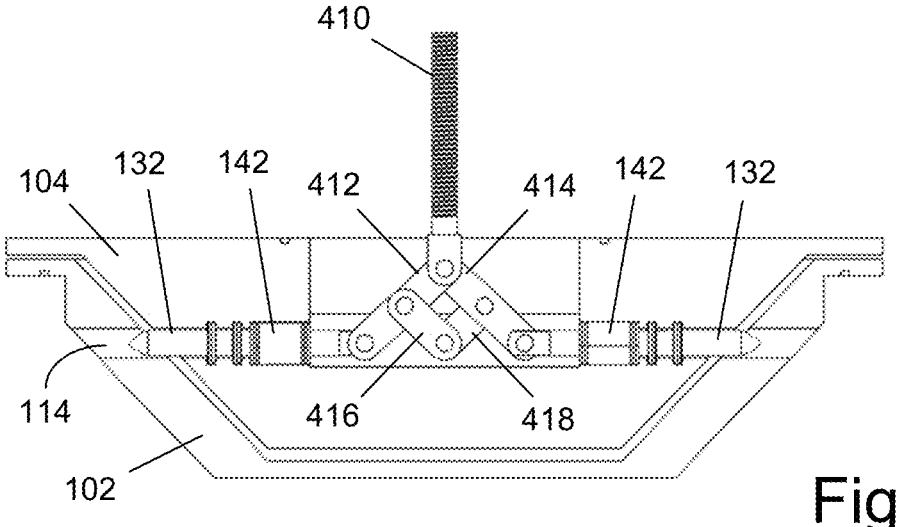
FIG. 4B is a top plan view of the lower half of the surface vehicle connecting apparatus of FIG. 3A illustrating the male wedge mount and the female wedge mount in aligned contact with one another with the locking mechanism moving toward the locked state of FIG. 3B.
Figure 4C:
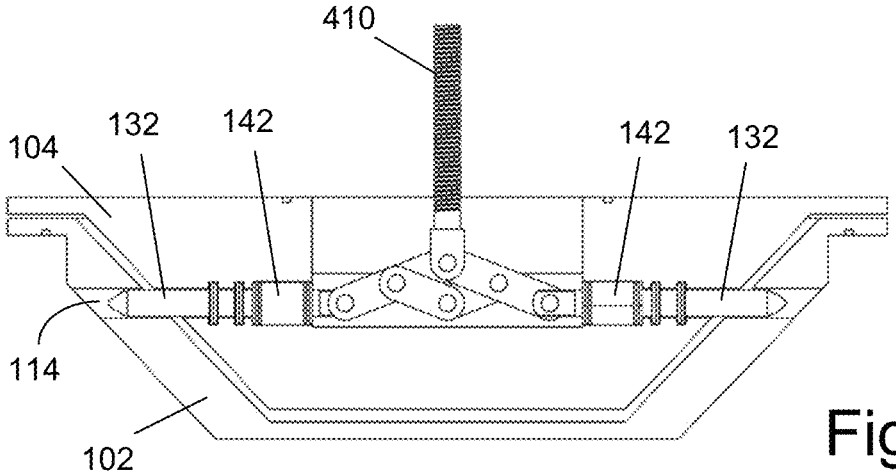
FIG. 4C is a top plan view of the lower half of the surface vehicle connecting apparatus of FIG. 3B illustrating the male wedge mount and the female wedge mount in aligned contact with one another with the locking mechanism in the locked state.

FIG. 4A is a top plan view of the lower half of the surface vehicle connecting apparatus of FIG. 3A illustrating the male wedge mount 104 and the female wedge mount 102 in aligned contact with one another with the locking mechanism 130 in an unlocked state of FIG. 3A. FIG. 4B is a top plan view of the lower half of the surface vehicle connecting apparatus of FIG. 3A illustrating the male wedge mount 104 and the female wedge mount 102 in aligned contact with one another with the locking mechanism 130 moving toward the locked state of FIG. 3B. FIG. 4C is a top plan view of the lower half of the surface vehicle connecting apparatus of FIG. 3B illustrating the male wedge mount 104 and the female wedge mount 102 in aligned contact with one another with the locking mechanism 130 in the locked state.

In the embodiment shown, the locking or engagement mechanism 130 includes a drive shaft 410 oriented generally perpendicular to the locking pins 132. The drive shaft 410 is connected with the locking pins 132 via a four-bar linkage mechanism to move the locking pins 132 between the unlocked position of FIG. 4A and the locked position of FIG. 4C. A first bar 412 is connected between the drive shaft 410 via a first pivot pin and the left-side locking pin 132 via a second pivot pin. A second bar 414 is connected between the drive shaft 410 via a pivot pin (which may be the first pivot pin or a separate pivot pin) and the right-side locking pin 132 via a third pivot pin. A third bar 416 is connected to the first bar 412 via a fourth pivot pin spaced from the first pivot pin. A fourth bar 418 is connected to the second bar 414 via a fifth pivot pin spaced from the first pivot pin. The third bar and the fourth bar are connected with one another via a sixth pivot pin. In this example, the drive shaft 410 is attached to the male wedge mount 104 and driven to move by the second surface vehicle, mechanically, hydraulically or pneumatically, electrically, or the like.

In alternative embodiments, the drive shaft 410 may be attached to the female wedge mount 102 instead. The four-bar linkage mechanism may be replaced by a different mechanical structure or a pneumatic system or an electrical system or the like for actuating the locking pins 132 between the unlocked state and the locked state.

The locking pins 132 may be made of a hard material such as hardened steel to withstand the loading experienced at the connections between the surface vehicles. The wedge mounts 102, 104 may be made of a variety of suitable materials including polymers, structural plastics, and metals such as aluminum. The male wedge slots 124 and female wedge slots 114 experience loading from the weights of the surface vehicles and any payload when the locking pins 132 are engaged. To maintain structural integrity of the wedge mounts 102, 104, the male wedge slots 124 and female wedge slots 114 may be reinforced by collars made of hardened steel or the like.

Figure 5A:
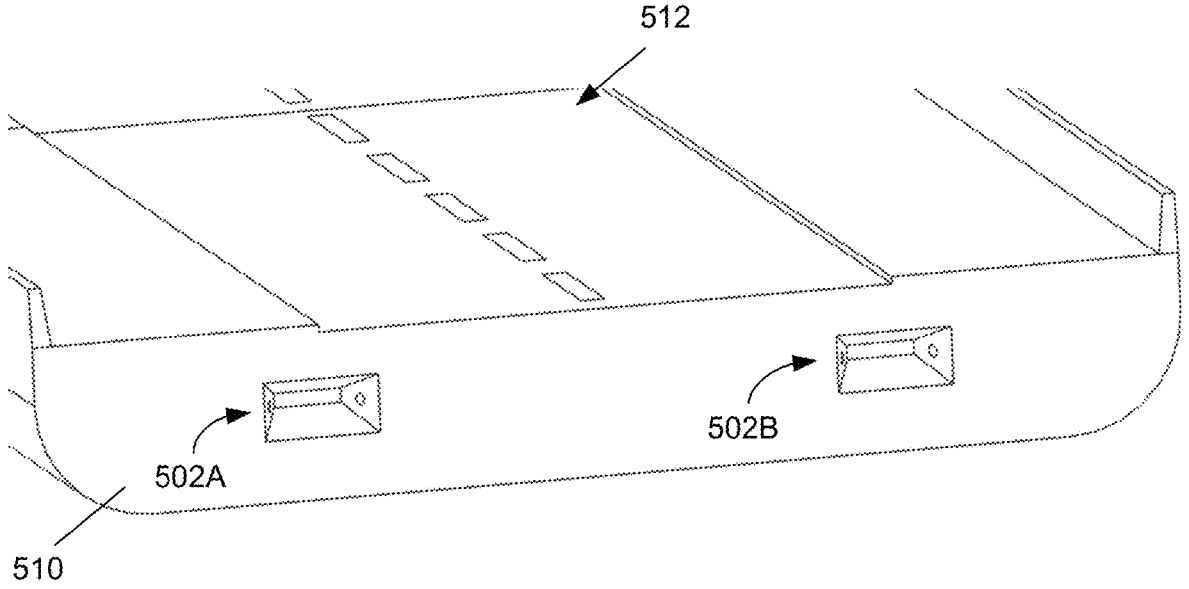
FIG. 5A is a perspective view of a first surface vehicle having two laterally spaced female wedge mounts of two laterally spaced connecting apparatuses of FIG. 1.
Figure 5B:
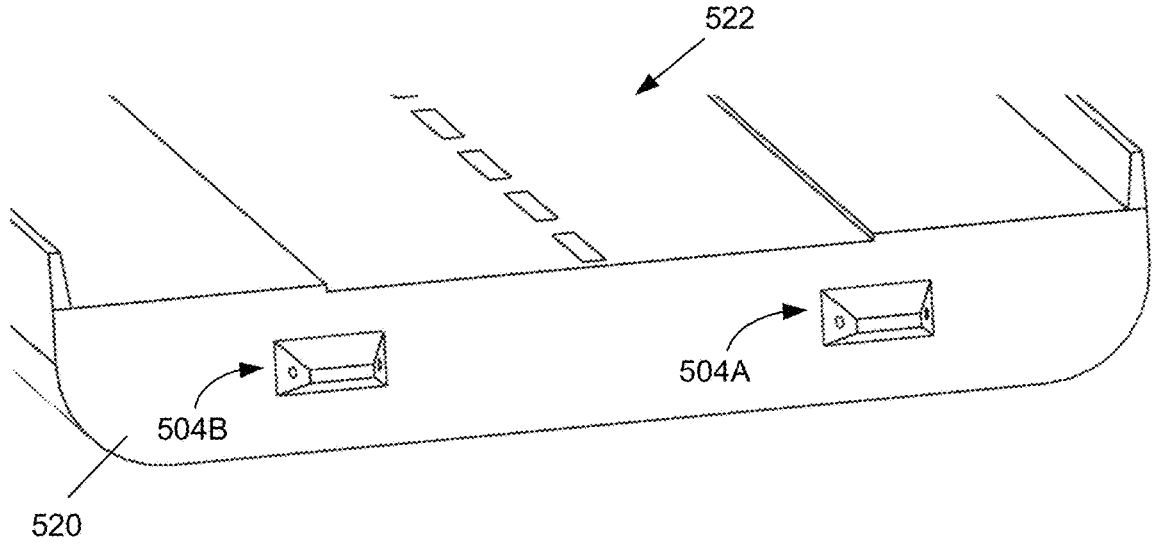
FIG. 5B is a perspective view of a second surface vehicle having two laterally spaced male wedge mounts of two laterally spaced connecting apparatuses of FIG. 1.

FIG. 5A is a perspective view of a first surface vehicle 510 having two laterally spaced female wedge mounts 502A, 502B of two laterally spaced connecting apparatuses of FIG. 1. FIG. 5B is a perspective view of a second surface vehicle 520 having two laterally spaced male wedge mounts 504A, 504B of two laterally spaced connecting apparatuses of FIG. 1. The wedge mounts are disposed on the sides of the surface vehicles for making an adjacent connection, which may be side-by-side or front-to-back. In the embodiment shown, the wedge mounts are disposed on the front and back ends of the surface vehicles for making a front-to-back connection.

The number of wedge mounts may be one or greater per surface vehicle (510, 520). Generally, each surface vehicle may include a plurality of the female wedge mounts 502A, 502B configured to be attached to the first surface vehicle 510 and a plurality of the male wedge mounts 504A, 504B configured to be attached to the second surface vehicle 520 and to be in aligned contact with the plurality of female wedge mounts 502A, 502B, respectively, to form the adjacent connection. A plurality of engaging or locking mechanisms (e.g., 130 in FIG. 1) are each configured to engage a pair of female wedge mount and male wedge mount (502A & 504A or 502B & 504B) of the plurality of female wedge mounts and the plurality of male wedge mounts and each including at least two locking pins (132 in FIG. 1) that are, when the convex contact surface of the male wedge mount and the concave contact surface of the female wedge mount are in aligned contact with one another, movable between the first position (see, e.g., FIG. 3B and FIG. 4C) and the second position (see, e.g., FIG. 3A and FIG. 4A), the at least two locking pins in the first position extending through the at least two male wedge slots (124 in FIG. 3B and FIG. 4C) and the at least two female wedge slots (114 in FIG. 3A and FIG. 4A), respectively, the at least two locking pins in the second position withdrawing from the at least two female wedge slots or the at least two male wedge slots, respectively.

For multiple wedge mounts, the wedge mounts may be laterally spaced along the side of the surface vehicle in any suitable way to achieve a specific purpose. In the embodiment shown, each surface vehicle has two wedge mounts that are spaced by approximately a track width of land vehicles to be supported on top of the surface vehicles. This spacing configuration may achieve superior load bearing performance for supporting the land vehicles. Additional wedge mounts may be provided at different height levels.

Figure 6A:
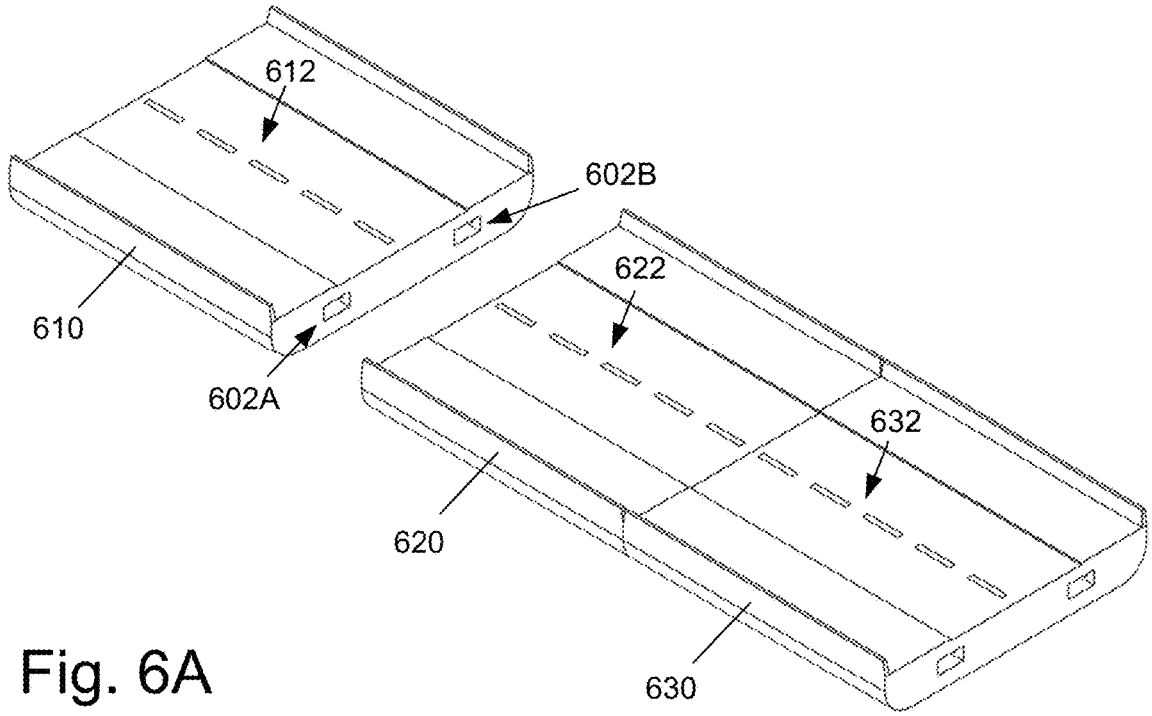
FIG. 6A is a perspective view of a plurality of surface vehicles illustrating the use of two laterally spaced male wedge mounts of two laterally spaced connecting apparatuses of FIG. 1 to form adjacent connections of the surface vehicles.
Figure 6B:
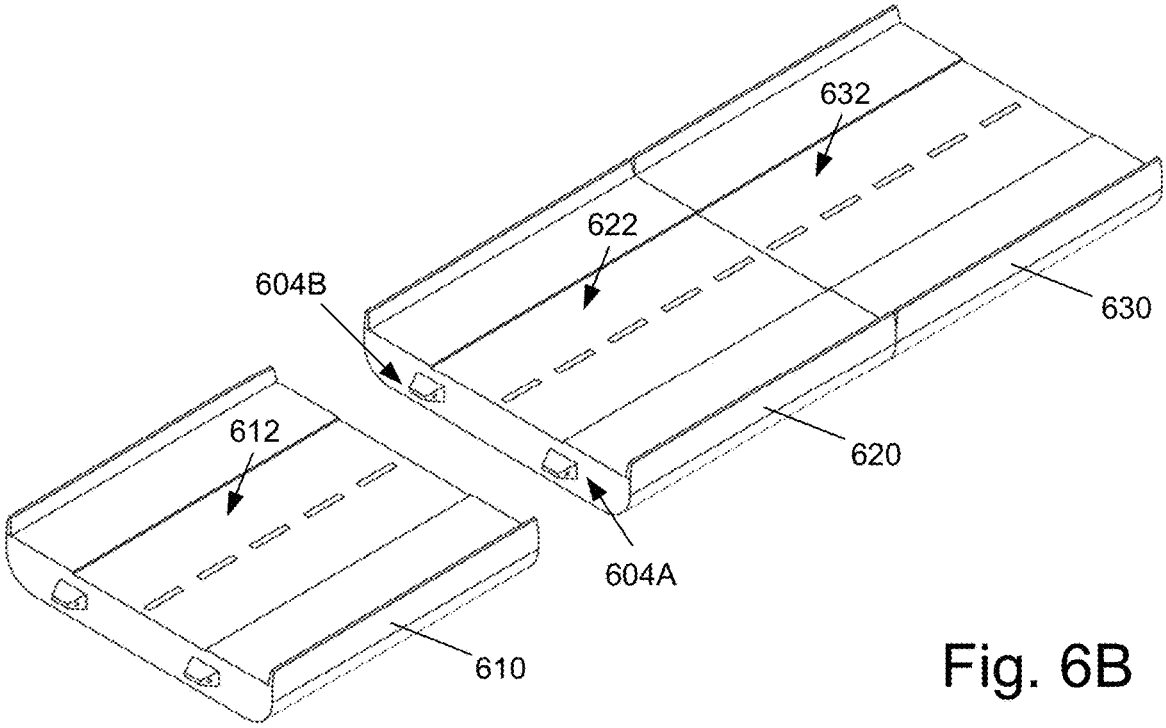
FIG. 6B is a perspective view of the plurality of surface vehicles of FIG. 6A illustrating the use of two laterally spaced female wedge mounts of two laterally spaced connecting apparatus of FIG. 1 to form adjacent connections of the surface vehicles.

FIG. 6A is a perspective view of a plurality of surface vehicles 610, 620, 630 illustrating the use of two laterally spaced male wedge mounts 604A, 604B of two laterally spaced connecting apparatuses of FIG. 1 to form adjacent connections of the surface vehicles. FIG. 6B is a perspective view of the plurality of surface vehicles 610, 620, 630 of FIG. 6A illustrating the use of two laterally spaced female wedge mounts 602A, 602B of two laterally spaced connecting apparatus of FIG. 1 to dock and form adjacent connections of the surface vehicles. The surface vehicles are configured for front-to-back connections. Two or more surface vehicles may be connected front-to-back. For example, the female wedge mounts 602A, 602B are provided on a trail edge of the surface vehicles and the male wedge mounts 604A, 604B are provided on a lead edge of the surface vehicles.

In the embodiment shown, an upper surface 612 of the first surface vehicle 610 and an upper surface 622 of the second surface vehicle 620 (as well as the upper surface 632 of the third surface vehicle 630) are aligned when the convex contact surface of the male wedge mounts 604A, 604B and the concave contact surface of the female wedge mount 602A, 602B are in aligned contact with one another to form the adjacent connection. The connected surface vehicles may be used for transporting payloads such as land vehicles on the upper surfaces 612, 622, 632. By combining a sufficient number of surface vehicles, a bridge may be formed across a body of water.

Figure 7A:
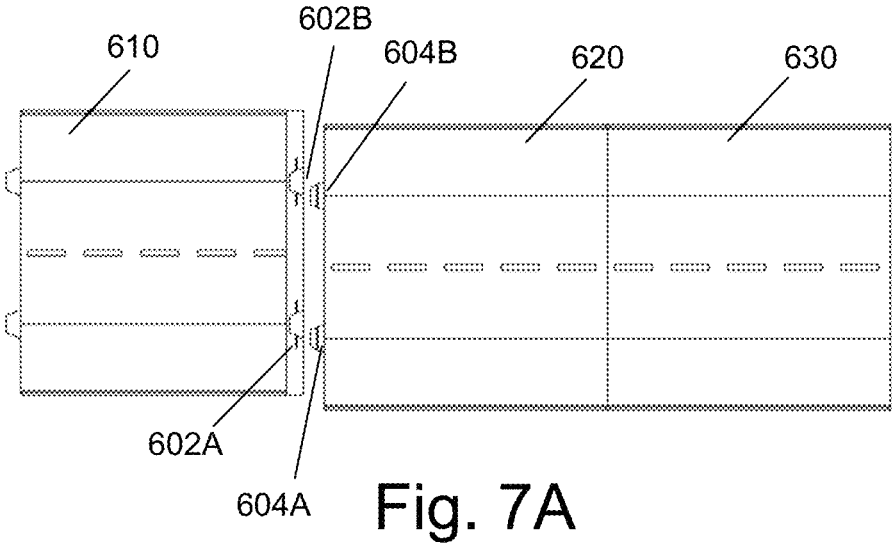
FIG. 7A is a top plan view of the plurality of surface vehicles of FIG. 6A illustrating the two laterally spaced connecting apparatuses in which the two laterally spaced male wedge mounts are separated from the two laterally spaced female wedge mounts, respectively.
Figure 7B:
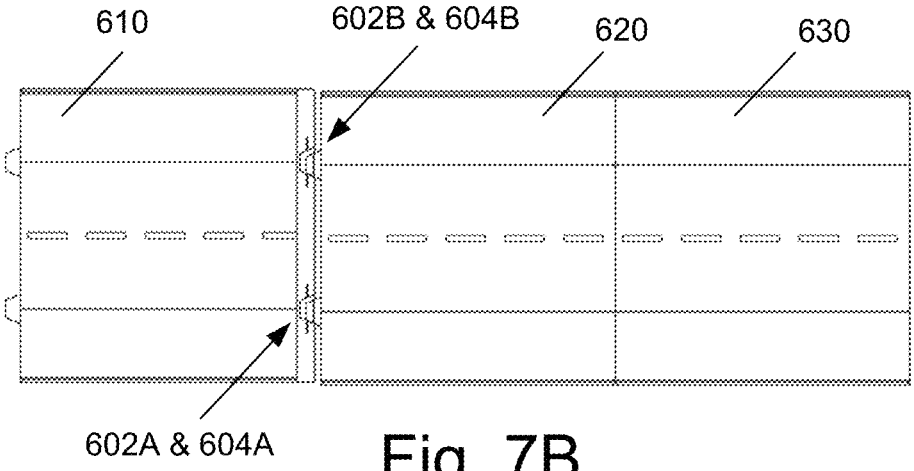
FIG. 7B is a top plan view of the plurality of surface vehicles of FIG. 6A illustrating the two laterally spaced connecting apparatuses in which the two laterally spaced male wedge mounts approach the two laterally spaced female wedge mounts, respectively.
Figure 7C:
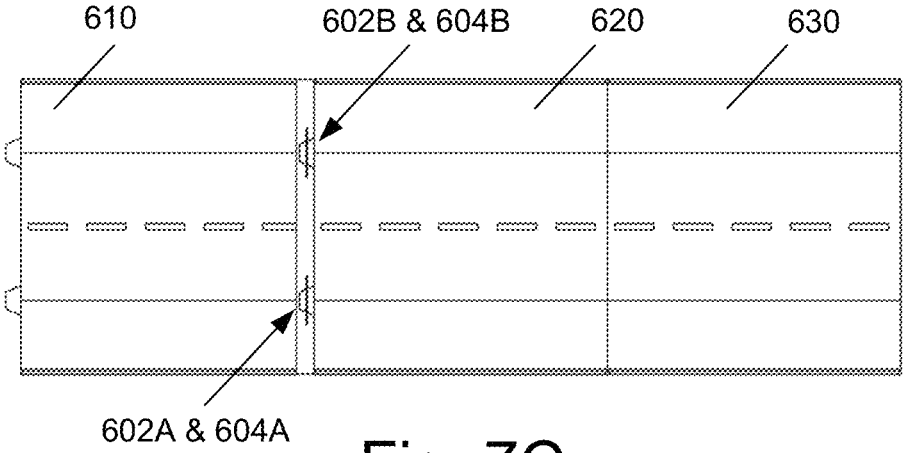
FIG. 7C is a top plan view of the plurality of surface vehicles of FIG. 6A illustrating the two laterally spaced connecting apparatuses in which the two laterally spaced male wedge mounts and the two laterally spaced female wedge mounts are in aligned contact with one another, respectively.

FIG. 7A is a top plan view of the plurality of surface vehicles 610, 620, 630 of FIG. 6A illustrating the two laterally spaced connecting apparatuses in which the two laterally spaced male wedge mounts 604A, 604B are separated from the two laterally spaced female wedge mounts 602A, 602B, respectively. FIG. 7B is a top plan view of the plurality of surface vehicles 610, 620, 630 of FIG. 6A illustrating the two laterally spaced connecting apparatuses in which the two laterally spaced male wedge mounts 604A, 604B approach the two laterally spaced female wedge mounts 602A, 602B, respectively. FIG. 7C is a top plan view of the plurality of surface vehicles 610, 620, 630 of FIG. 6A illustrating the two laterally spaced connecting apparatuses in which the two laterally spaced male wedge mounts 604A, 604B and the two laterally spaced female wedge mounts 602A, 602B are in aligned contact or aligned wedge contact with one another, respectively. As discussed above for the wedge mounts each having four contact surface segments, the left side and right side contact surface segments (216, 218, 226, 228 in FIG. 2) are oriented to align the female wedge mount 602 and the male wedge mount 604 horizontally. The upper and lower contact surface segments (212, 214, 222, 224 in FIG. 2) are oriented to align the female wedge mount 602 and the male wedge mount 604 vertically. The wedge configuration enables the female wedge mount 602 and the male wedge mount 604 to self-align by sliding contact from the separated state of FIG. 7A to the approach state of FIG. 7B to the aligned contact state of FIG. 7C, without the need for human intervention or input.

For each connecting apparatus, when the female wedge mount 602 and the male wedge mount 604 are docked in aligned contact, the locking mechanism (130 in FIG. 1 and FIGS. 4A-4C) may automatically be actuated to move the locking pins 132 from the unlocked state (see FIG. 4A) to the locked state (see FIG. 4C). Sensors may be provided on the wedge mounts 102, 104 and/or the surface vehicles 610, 620, 630 to detect whether the wedge mounts are in aligned contact. When aligned contact is detected, the sensors may send a signal to a controller to actuate the locking mechanism 130 to lock the wedge mounts 602, 604 by moving the locking pins 132 to the locking position. The sensors may be proximity sensors such as optical sensors based on laser technology or the like. The sensors may be provided on or about the surfaces of the surface vehicles or wedge mounts such as connection surfaces that are configured to be connected in the adjacent connection between the surface vehicles.

Figure 8:
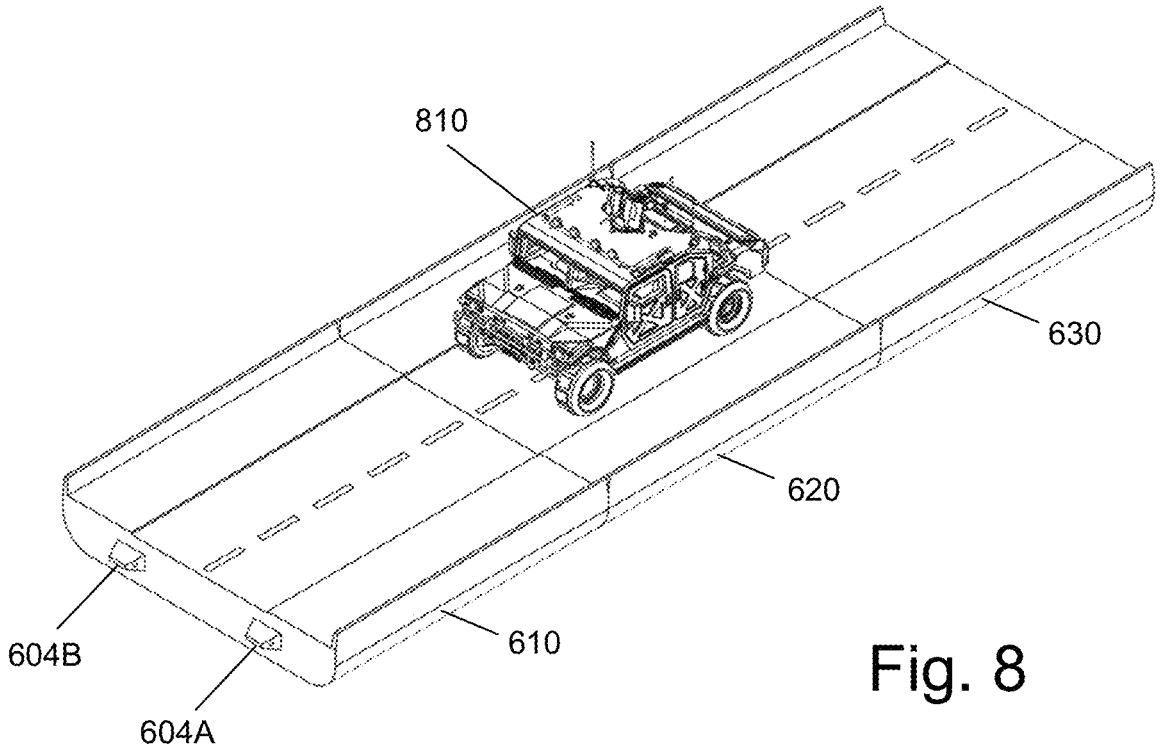
FIG. 8 illustrates a perspective view of three surface vehicles connected in series for supporting a (land vehicle) payload.
Figure 9:
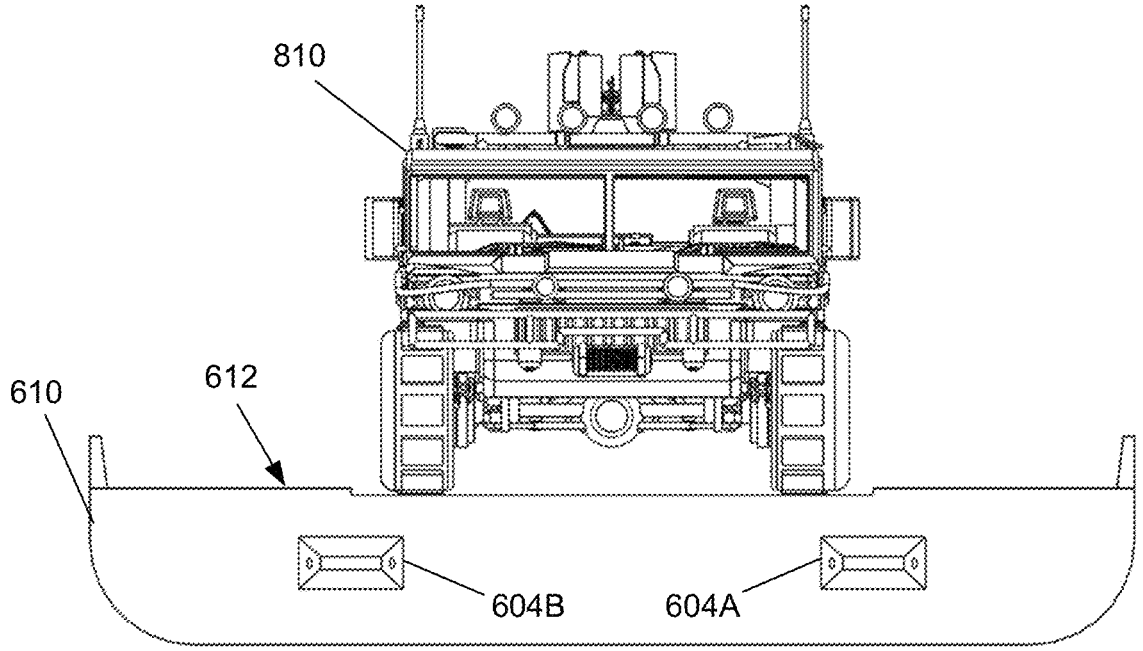
FIG. 9 illustrates a front view of the three surface vehicles of FIG. 8 connected in series for supporting the payload.

FIG. 8 illustrates a perspective view of three surface vehicles 610, 620, 630 connected in series for supporting a payload 810. FIG. 9 illustrates a front view of the three surface vehicles 610, 620, 630 of FIG. 8 connected in series for supporting the payload 810. The payload 810 may include one or more land vehicles or the like. The wedge mounts (602A, 602B and 604A, 604B) may be laterally spaced by approximately the track width of the land vehicle to be disposed generally below the wheels of the land vehicle, respectively, to achieve superior load bearing performance for supporting the land vehicle(s).

Figure 10A:
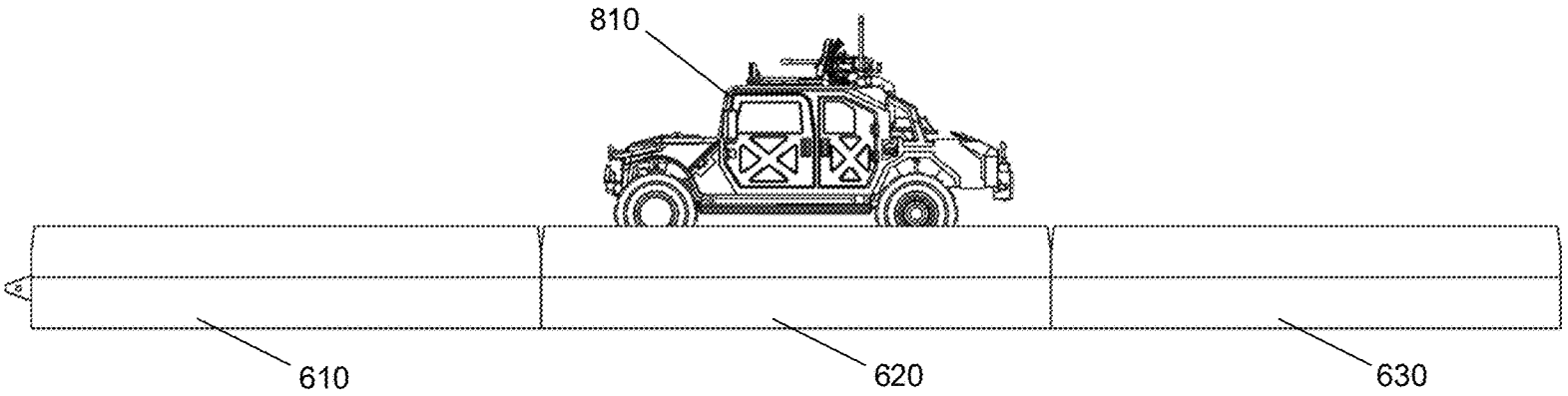
FIG. 10A illustrates a side view of the three surface vehicles of FIG. 8 connected in series for supporting the payload.
Figure 10B:
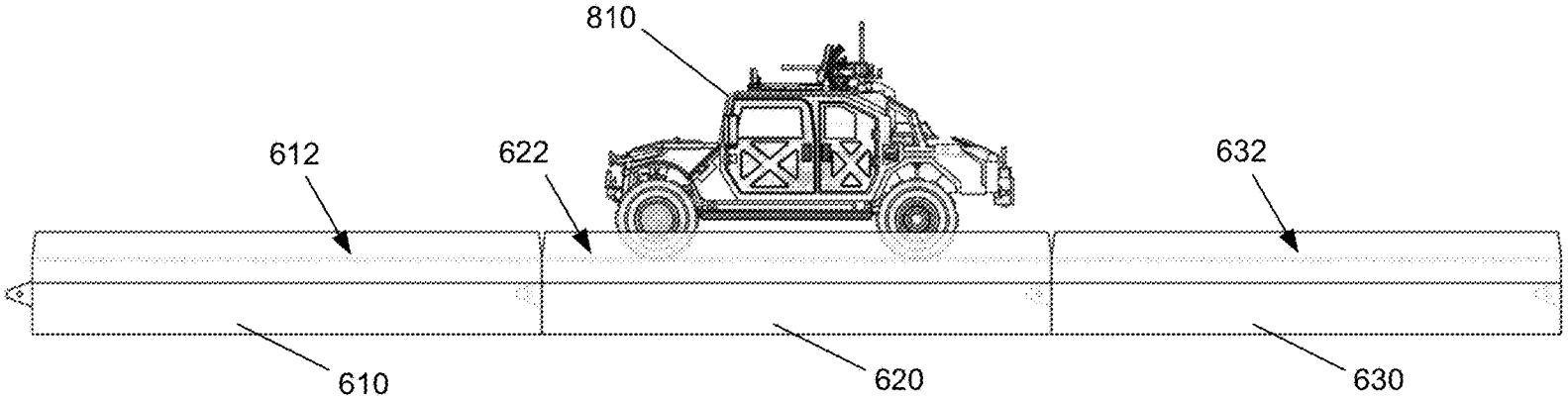
FIG. 10B is another side view of FIG. 10A illustrating the upper surfaces of the three surface vehicles connected in series for supporting the payload.

FIG. 10A illustrates a side view of the three surface vehicles 610, 620, 630 of FIG. 8 connected in series for supporting the payload 810. FIG. 10B is another side view of FIG. 10A illustrating the upper surfaces 612, 622, 632 of the three surface vehicles 610, 620, 630 connected in series for supporting the payload 810.

Figure 11A:
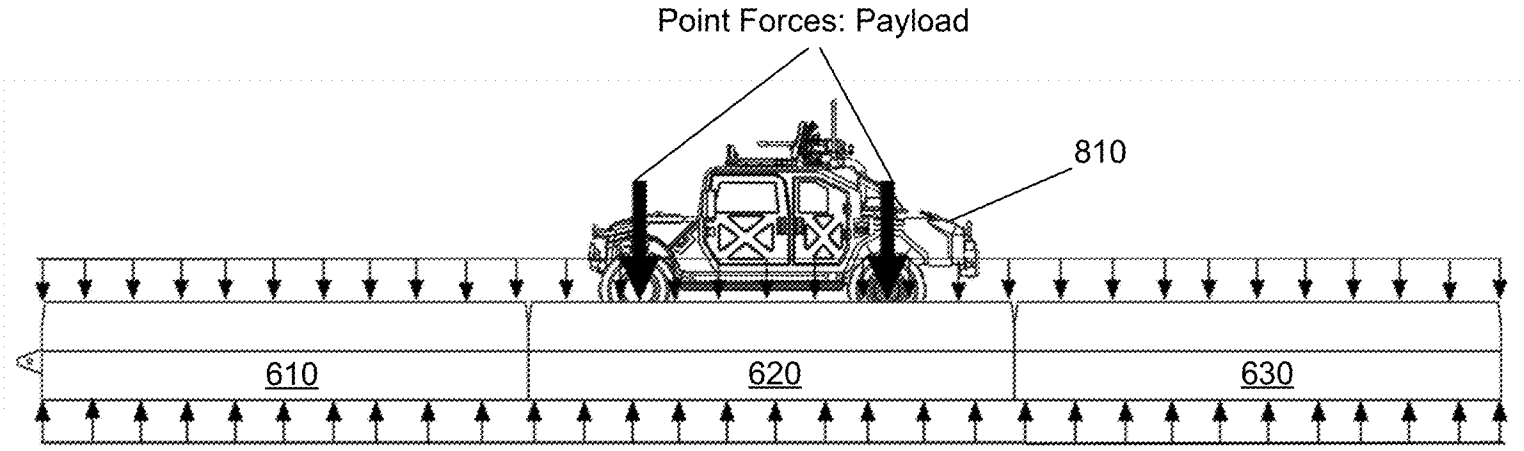
FIG. 11A is the side view of the three surface vehicles of FIG. 10A illustrating a free body diagram of loading forces on the three surface vehicles connected in series.

FIG. 11A is the side view of the three surface vehicles 610, 620, 630 of FIG. 10A illustrating a free body diagram of loading forces on the three surface vehicles connected in series. The dead weights of the surface vehicles or rafts 610, 620, 630 are represented by the distributed force by gravity pointing downward. The land vehicle payload 810 has point forces from the wheels in contact with the surface vehicle 620. The surface vehicles 610, 620, 630 float on a body water that provides an opposing distributed force of buoyancy upward.

Figure 11B:
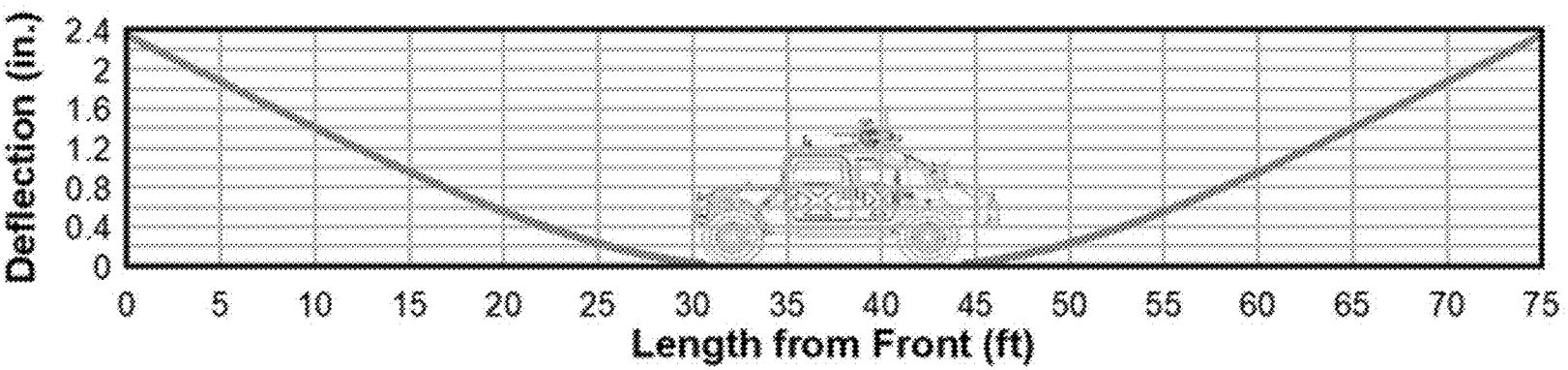
FIG. 11B is a plot of resultant system deflections of the three surface vehicles of FIG. 11A from the front to the rear of the three surface vehicles connected in series.

FIG. 11B is a plot of resultant system deflections of the three surface vehicles 610, 620, 630 of FIG. 11A from the front (lead edge) to the rear (trail edge) of the three surface vehicles 610, 620, 630 connected in series. This can be used to evaluate the structural capacity requirements for the surface vehicle connecting apparatuses 100. As mentioned above, the wedge mounts (602A, 602B and 604A, 604B) may be laterally spaced by approximately the track width of the land vehicle to be disposed generally below the wheels of the land vehicle, respectively, to achieve superior load bearing performance for supporting the point forces exerted via the wheels of the land vehicle(s) 810.

Figure 12:
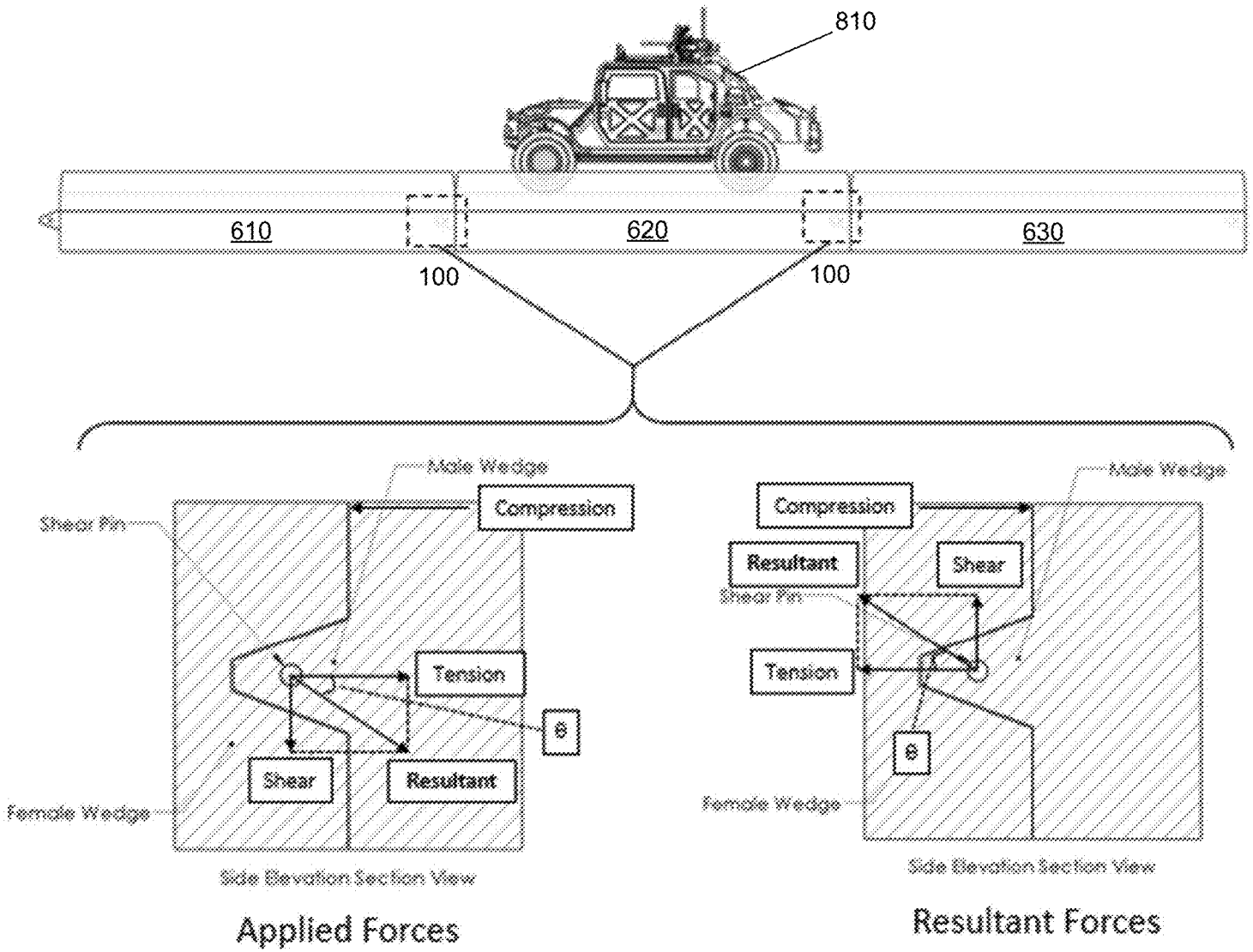
FIG. 12 illustrates applied forces and resultant forces on the surface vehicle connecting apparatuses at the three surface vehicles of FIG. 11A connected in series for supporting the payload.

FIG. 12 illustrates applied forces and resultant forces on the surface vehicle connecting apparatuses 100 at the three surface vehicles 610, 620, 630 of FIG. 11A connected in series for supporting the payload 810. The applied forces include a compression force on the top edge of the female wedge mount (e.g., 602A or 602B) and a force on the locking pin (e.g., 132) which has a tension component opposite from the compression force and a shear component perpendicular to the compression force in a downward direction. The resultant forces include a compressive force on the top edge of the male wedge mount (e.g., 604A or 604B) and a force by the locking pin which has a tension component opposite from the compression force and a shear component perpendicular to the compression force in an upward direction. As a result, the wedge mounts support compression component of the force couple through bearing surfaces and the locking pins support tension component of the force couple through shear strength of the horizontally oriented locking pins (or bending strength of vertically oriented locking pins for an alternative embodiment as discussed below).

Based on the material properties of the wedge mounts and locking pins and based on weights of the surface vehicles, a maximum allowable weight of the payload to be carried by the connected surface vehicle can be calculated. Alternatively, to support the weight of a desired payload on the connected surface vehicles, the minimum required material properties of the wedge mounts and locking pins can be calculated based on the weight of the payload and the weights of the surface vehicles. As mentioned above, a strengthening collar (e.g., made of hardened steel) may be provided between the locking pins and the slots in which the locking pins move and engage the wedge mounts.

In an alternative embodiment, the horizontal wedge slots 114, 124 and horizontal locking pins 132 may be replaced by vertical wedge slots and vertical locking pins. In that case, the female wedge mount has at least two vertical female wedge slots that extend through the upper female contact surface segment and the lower female contact surface segment, respectively, and the male wedge mount has at least two vertical male wedge slots that extend through the upper male contact surface segment and the lower male contact surface segment, respectively, and are aligned with the at least two vertical female wedge slots, respectively, when the convex contact surface of the male wedge mount and the concave contact surface of the female wedge mount are in aligned contact with one another to form the adjacent connection. While the horizontally oriented locking pins 132 are shear pins loaded in shear in the embodiments shown, the vertically oriented locking pins are loaded in bending in the alternative embodiment and provide a greater moment capability than the shear pins 132.

In another alternative embodiment, the first surface vehicle and the second surface vehicle may each include a male wedge mount and a female wedge mount. The male wedge mount of the first surface vehicle is configured to make aligned wedge contact with the female wedge mount of the second surface vehicle. The female wedge mount of the first surface vehicle is configured to make aligned wedge contact with the male wedge mount of the second surface vehicle.

Embodiments of the invention can be manifest in the form of methods and apparatuses for practicing those methods.

Unless explicitly stated otherwise, each numerical value and range should be interpreted as being approximate as if the word "about" or "approximately" preceded the value or range.

Unless otherwise indicated, all numbers expressing quantities of ingredients, properties such as molecular weight, percent, ratio, reaction conditions, and so forth used in the specification and claims are to be understood as being modified in all instances by the term "about," whether or not the term "about" is present. Accordingly, unless indicated to the contrary, the numerical parameters set forth in the specification and claims are approximations that may vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques. Notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in their respective testing measurements.

It will be further understood that various changes in the details, materials, and arrangements of the parts which have been described and illustrated in order to explain embodiments of this invention may be made by those skilled in the art without departing from embodiments of the invention encompassed by the following claims.

In this specification including any claims, the term "each" may be used to refer to one or more specified characteristics of a plurality of previously recited elements or steps. When used with the open-ended term "comprising," the recitation of the term "each" does not exclude additional, unrecited elements or steps. Thus, it will be understood that an apparatus may have additional, unrecited elements and a method may have additional, unrecited steps, where the additional, unrecited elements or steps do not have the one or more specified characteristics.

It should be understood that the steps of the exemplary methods set forth herein are not necessarily required to be performed in the order described, and the order of the steps of such methods should be understood to be merely exemplary. Likewise, additional steps may be included in such methods, and certain steps may be omitted or combined, in methods consistent with various embodiments of the invention.

Although the elements in the following method claims, if any, are recited in a particular sequence with corresponding labeling, unless the claim recitations otherwise imply a particular sequence for implementing some or all of those elements, those elements are not necessarily intended to be limited to being implemented in that particular sequence.

All documents mentioned herein are hereby incorporated by reference in their entirety or alternatively to provide the disclosure for which they were specifically relied upon.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments necessarily mutually exclusive of other embodiments. The same applies to the term "implementation."

The embodiments covered by the claims in this application are limited to embodiments that (1) are enabled by this specification and (2) correspond to statutory subject matter. Non-enabled embodiments and embodiments that correspond to non-statutory subject matter are explicitly disclaimed even if they fall within the scope of the claims.

What is claimed is:

1. An apparatus for making an adjacent connection between a first surface vehicle and a second surface vehicle, the apparatus comprising:

a female wedge mount configured to be attached to the first surface vehicle, the female wedge mount having a concave contact surface including three or more female contact surface segments, the female wedge mount having at least two female wedge slots;

a male wedge mount configured to be attached to the second surface vehicle, the male wedge mount having a convex contact surface including three or more male contact surface segments corresponding to and matching in shape with, respectively, the three or more female contact surface segments, the male wedge mount having at least two male wedge slots that are aligned with the at least two female wedge slots, respectively, when the convex contact surface of the male wedge mount and the concave contact surface of the female wedge mount are in aligned contact with one another to form the adjacent connection; and a mechanism configured to engage the female wedge mount and the male wedge mount and including at least two pins that are, when the convex contact surface of the male wedge mount and the concave contact surface of the female wedge mount are in aligned contact with one another, movable between a first position and a second position, the at least two pins in the first position extending through the at least two male wedge slots and the at least two female wedge slots, respectively, the at least two pins in the second position withdrawing from the at least two female wedge slots or the at least two male wedge slots, respectively.

2. The apparatus of claim 1, wherein an upper surface of the first surface vehicle and an upper surface of the second surface vehicle are aligned when the convex contact surface of the male wedge mount and the concave contact surface of the female wedge mount are in aligned contact with one another to form the adjacent connection.

3. The apparatus of claim 1, comprising:

a plurality of the female wedge mounts configured to be attached to the first surface vehicle;

a plurality of the male wedge mounts configured to be attached to the second surface vehicle and to be in aligned contact with the plurality of female wedge mounts, respectively, to form the adjacent connection; and a plurality of the mechanisms each configured to engage a pair of female wedge mount and male wedge mount of the plurality of female wedge mounts and the plurality of male wedge mounts and each including at least two pins that are, when the convex contact surface of the male wedge mount and the concave contact surface of the female wedge mount are in aligned contact with one another, movable between the first position and the second position, the at least two pins in the first position extending through the at least two male wedge slots and the at least two female wedge slots, respectively, the at least two pins in the second position withdrawing from the at least two female wedge slots or the at least two male wedge slots, respectively.

4. The apparatus of claim 1, wherein the three or more female contact surface segments are each planar and the three or more male contact surface segments are each planar and match in shape with, respectively, the three or more planar female contact surface segments.

5. The apparatus of claim 1, wherein at least two of the three or more female contact surface segments correspond to and match in shape with, respectively, at least two of the three or more male contact surface segments and are oriented to align the female wedge mount and the male wedge mount horizontally; and wherein at least two of the three or more female contact surface segments correspond to and match in shape with, respectively, at least two of the three or more male contact surface segments and are oriented to align the female wedge mount and the male wedge mount vertically.

6. The apparatus of claim 1, wherein the concave contact surface of the female wedge mount has four female contact surface segments and the convex contact surface of the male wedge mount has four male contact surface segments corresponding to and matching in shape with, respectively, the four female contact surface segments.

7. The apparatus of claim 6, wherein the four female contact surface segments of the concave contact surface of the female wedge mount include an upper female contact surface segment, a lower female contact surface segment, a left side female contact surface segment, and a right side female contact surface segment; and wherein the four male contact surface segments of the convex contact surface of the male wedge mount include an upper male contact surface segment, a lower male contact surface segment, a left side male contact surface segment, and a right side male contact surface segment.

8. The apparatus of claim 7, wherein the female wedge mount has at least two horizontal female wedge slots that extend through the left side female contact surface segment and the right side female contact surface segment, respectively, and the male wedge mount has at least two horizontal male wedge slots that extend through the left side male contact surface segment and the right side male contact surface segment, respectively, and that are aligned with the at least two horizontal female wedge slots, respectively, when the convex contact surface of the male wedge mount and the concave contact surface of the female wedge mount are in aligned contact with one another to form the adjacent connection.

9. The apparatus of claim 7, wherein the female wedge mount has at least two vertical female wedge slots that extend through the upper female contact surface segment and the lower female contact surface segment, respectively, and the male wedge mount has at least two horizontal male wedge slots that extend through the upper male contact surface segment and the lower male contact surface segment, respectively, and are aligned with the at least two vertical female wedge slots, respectively, when the convex contact surface of the male wedge mount and the concave contact surface of the female wedge mount are in aligned contact with one another to form the adjacent connection.

10. An apparatus for making an adjacent connection between a first surface vehicle and a second surface vehicle, the apparatus comprising:

a female wedge mount configured to be attached to the first surface vehicle, the female wedge mount having three or more female contact surface segments, the female wedge mount having at least two female wedge slots;

a male wedge mount configured to be attached to the second surface vehicle, the male wedge mount having three or more male contact surface segments, the male wedge mount having at least two male wedge slots that are aligned with the at least two female wedge slots, respectively, when the three or more male contact surface segments of the male wedge mount and the three or more female contact surface segments of the female wedge mount are in aligned contact with one another, respectively, to form the adjacent connection;

at least two of the three or more female contact surface segments corresponding to and matching in shape with, respectively, at least two of the three or more male contact surface segments and oriented to align the female wedge mount and the male wedge mount horizontally;

at least two of the three or more female contact surface segments corresponding to and matching in shape with, respectively, at least two of the three or more male contact surface segments and oriented to align the female wedge mount and the male wedge mount vertically; and a mechanism configured to engage the female wedge mount and the male wedge mount and including at least two pins that are, when the three or more male contact surface segments of the male wedge mount and the three or more female contact surface segments of the female wedge mount are in aligned contact with one another, movable between a first position and a second position, the at least two pins in the first position extending through the at least two male wedge slots and the at least two female wedge slots, respectively, the at least two pins in the second position withdrawing from the at least two female wedge slots or the at least two male wedge slots, respectively.

11. The apparatus of claim 10, wherein the three or more female contact surface segments are each planar and the three or more male contact surface segments are each planar and match in shape with, respectively, the three or more planar female contact surface segments.

12. The apparatus of claim 10, wherein the female wedge mount has four female contact surface segments including an upper female contact surface segment, a lower female contact surface segment, a left side female contact surface segment, and a right side female contact surface segment;

wherein the male wedge mount has four male contact surface segments including an upper male contact surface segment, a lower male contact surface segment, a left side male contact surface segment, and a right side male contact surface segment, wherein the upper female contact surface segment match in shape with the upper male contact surface segment and the lower female contact surface segment match in shape with the lower male contact surface segment to align the female wedge mount and the male wedge mount vertically; and wherein the left side female contact surface segment match in shape with the left side male contact surface segment and the right side female contact surface segment match in shape with the right side male contact surface segment to align the female wedge mount and the male wedge mount horizontally.

13. The apparatus of claim 12, wherein the female wedge mount has at least two horizontal female wedge slots that extend through the left side female contact surface segment and the right side female contact surface segment, respectively, and the male wedge mount has at least two horizontal male wedge slots that extend through the left side male contact surface segment and the right side male contact surface segment, respectively, and that are aligned with the at least two horizontal female wedge slots, respectively, when the three or more male contact surface segments of the male wedge mount and the three or more female contact surface segments of the female wedge mount are in aligned contact with one another to form the adjacent connection.

14. The apparatus of claim 12, wherein the female wedge mount has at least two vertical female wedge slots that extend through the upper female contact surface segment and the lower female contact surface segment, respectively, and the male wedge mount has at least two horizontal male wedge slots that extend through the upper male contact surface segment and the lower male contact surface segment, respectively, and are aligned with the at least two vertical female wedge slots, respectively, when the three or more male contact surface segments of the male wedge mount and the three or more female contact surface segments of the female wedge mount are in aligned contact with one another to form the adjacent connection.

15. A method for making an adjacent connection between a first surface vehicle and a second surface vehicle, the method comprising:

attaching a first female wedge mount to the first surface vehicle, the first female wedge mount having three or more first female contact surface segments, the first female wedge mount having at least two first female wedge slots;

attaching a first male wedge mount to the second surface vehicle, the first male wedge mount having three or more first male contact surface segments, the first male wedge mount having at least two first male wedge slots;

bringing the three or more first male contact surface segments of the first male wedge mount and the three or more first female contact surface segments of the first female wedge mount in aligned contact with one another, respectively, to form the adjacent connection, in which the at least two first male wedge slots are aligned with the at least two first female wedge slots, respectively;

at least two of the three or more first female contact surface segments corresponding to and matching in shape with, respectively, at least two of the three or more first male contact surface segments and oriented to align the first female wedge mount and the first male wedge mount horizontally;

at least two of the three or more first female contact surface segments corresponding to and matching in shape with, respectively, at least two of the three or more first male contact surface segments and oriented to align the first female wedge mount and the first male wedge mount vertically; and engaging the first female wedge mount and the first male wedge mount by moving at least two first pins to a first position extending through the at least two first male wedge slots and the at least two first female wedge slots, respectively.

16. The method of claim 15, further comprising:

disengaging the first female wedge mount from the first male wedge mount by moving the at least two first pins from the first position to a second position withdrawing from the at least two first female wedge slots or the at least two first male wedge slots, respectively.

17. The method of claim 15, further comprising:

attaching a second female wedge mount to the second surface vehicle, the second female wedge mount having three or more second female contact surface segments, the second female wedge mount having at least two second female wedge slots;

attaching a second male wedge mount to the second surface vehicle, the second male wedge mount having three or more second male contact surface segments, the second male wedge mount having at least two second male wedge slots;

bringing the three or more second male contact surface segments of the second male wedge mount and the three or more second female contact surface segments of the second female wedge mount in aligned contact with one another, respectively, to form the adjacent connection, in which the at least two second male wedge slots are aligned with the at least two second female wedge slots, respectively;

at least two of the three or more second female contact surface segments corresponding to and matching in shape with, respectively, at least two of the three or more second male contact surface segments and oriented to align the second female wedge mount and the second male wedge mount horizontally;

at least two of the three or more second female contact surface segments corresponding to and matching in shape with, respectively, at least two of the three or more second male contact surface segments and oriented to align the second female wedge mount and the second male wedge mount vertically; and engaging the second female wedge mount and the second male wedge mount by moving at least two second pins to a second position extending through the at least two second male wedge slots and the at least two second female wedge slots, respectively.

18. The method of claim 15, wherein bringing the three or more first male contact surface segments of the first male wedge mount and the three or more first female contact surface segments of the first female wedge mount in aligned contact with one another, respectively, to form the adjacent connection aligns an upper surface of the first surface vehicle and an upper surface of the second surface vehicle.

19. The method of claim 15, further comprising:

based on weights of the first surface vehicle and the second surface vehicle and a weight of a payload to be carried by the first and second surface vehicles connected together, calculating minimum required material properties of the first female wedge mount, the first male wedge mount, and the at least two first pins.

20. The method of claim 15, further comprising:

based on material properties of the first female wedge mount, the first male wedge mount, and the at least two first pins and based on weights of the first surface vehicle and the second surface vehicle, calculating a maximum allowable weight of a payload to be carried by the first and second surface vehicles connected together.

* * * * *